US012697528B2

(12) United States Patent
Quam et al.

(10) Patent No.: US 12,697,528 B2
(45) Date of Patent: Aug. 4, 2026

(54) RECUMBENT EXERCISE APPARATUS

(71) Applicant: Johnson Health Tech. Co., Ltd., Taichung city (TW)

(72) Inventors: Staci Quam, Waukesha, WI (US); Meng-Hung Tsai, Taichung city (TW)

(73) Assignee: Johnson Health Tech Co., Ltd., Taichung City (TW)

( * ) Notice: Subject to any disclaimer, the term of this patent is extended or adjusted under 35 U.S.C. 154(b) by 154 days.

(21) Appl. No.: 18/625,125

(22) Filed: Apr. 2, 2024

(65) Prior Publication Data

US 2025/0303228 A1 Oct. 2, 2025

(51) Int. Cl.

| | |
|---|---|
| ***A63B 22/06*** | (2006.01) |
| ***A63B 21/00*** | (2006.01) |
| ***A63B 22/00*** | (2006.01) |

(52) U.S. Cl.

CPC ..... *A63B 22/0605* (2013.01); *A63B 21/4034* (2015.10); *A63B 22/0025* (2015.10); *A63B 2022/0043* (2013.01); *A63B 2022/0652* (2013.01)

(58) Field of Classification Search

CPC .... A63B 2022/0652; A63B 2022/0043; A63B 2022/0611; A63B 2022/0617; A63B 2022/0635; A63B 2022/0676; A63B 22/0605; A63B 22/0025; A63B 22/0664; A63B 21/4034

See application file for complete search history.

(56) References Cited

U.S. PATENT DOCUMENTS

| | | | | |
|---|---|---|---|---|
| 5,836,855 | A * | 11/1998 | Eschenbach | A63B 22/0015 482/57 |
| 5,904,638 | A * | 5/1999 | Habing | A63B 22/0605 482/57 |
| 5,938,570 | A * | 8/1999 | Maresh | A63B 22/001 482/57 |
| 6,547,701 | B1 * | 4/2003 | Eschenbach | A63B 22/001 482/64 |
| 7,497,808 | B2 * | 3/2009 | Eschenbach | A63B 22/001 482/52 |
| 7,815,551 | B2 * | 10/2010 | Merli | A63B 22/001 482/52 |
| 9,067,094 | B2 * | 6/2015 | Chang | A63B 22/0015 |
| 9,616,280 | B2 * | 4/2017 | Chuang | A63B 22/0015 |

(Continued)

*Primary Examiner* — Megan Anderson
*Assistant Examiner* — Kathleen M Fisk

(57) ABSTRACT

An exercise apparatus includes a seat and a movement mechanism located in front of the seat, the movement mechanism has two pedals for the user to step on with both feet respectively. During exercise, the middle portion of each pedal cyclically displaces along a predetermined pedal exercise path based on the guidance of the movement mechanism. Additionally, an elevation angle of the toe end relative to the heel end gradually increases and decreases in a cycle period. The predetermined pedal exercise path includes a highest position, a lowest position, a frontmost position, a rearmost position, a maximum elevation position, and a minimum elevation position. The maximum elevation position is located within a path from the highest position to the lowest position, passing through the frontmost position. Similarly, the minimum elevation position is located within path from the lowest position to the highest position, passing through the rearmost position.

20 Claims, 11 Drawing Sheets

(56) References Cited

U.S. PATENT DOCUMENTS

| | | | | |
|---|---|---|---|---|
| 10,549,145 | B2 * | 2/2020 | Liao | A63B 21/0058 |
| 10,814,160 | B2 * | 10/2020 | Liao | A63B 22/205 |
| 10,933,273 | B2 * | 3/2021 | Liao | A63B 22/208 |
| 2004/0172093 | A1 * | 9/2004 | Rummerfield | A63B 22/0605 607/43 |
| 2004/0259692 | A1 * | 12/2004 | Martin | A63B 22/0017 482/52 |
| 2011/0028277 | A1 * | 2/2011 | Merli | A63B 23/03575 482/63 |

* cited by examiner

RECUMBENT EXERCISE APPARATUS

FIELD OF THE INVENTION

The present invention relates to an exercise apparatus. More particularly, the present invention relates to a recumbent exercise apparatus that allows a user to perform leg exercises in a seated position.

DESCRIPTION OF THE RELATED ART

In the category of indoor aerobic exercise equipment, stationary bikes stand out as equipment that allows users to perform leg exercises in a seated position. Among them, the more commonly upright bikes and spinning bikes involve body postures and leg movement similar to riding a regular bicycle or road bike. In other words, while sitting on a seat, the upper body upright or leaning forward, both hands gripping the fixed handlebar in front of the seat, and both feet rotating the pedal crank assembly beneath the seat, achieving the effect of exercising the legs and aerobic exercise. However, the aforementioned body posture and leg movement may be somewhat challenging and unsafe for individuals with lower physical fitness levels, such as the elderly and those in middle to old age.

The recumbent bike is a relatively gentle form of stationary bikes, as shown in FIG. 12. Its pedal crank assembly (represented by only two pedals 1 in the figure) is located in the front and below the seat 2. Correspondingly, there is a backrest 3 located behind and above the seat 2 to provide the user with support to lean against, allowing the user to perform leg exercises by pedaling in a more relaxed and comfortable posture. This is particularly suitable for individuals with lower exercise capacity, such as the elderly and those in middle to old age, or individuals looking for mild exercise. During exercise, each pedal 1 rotates along a predetermined circular path T. The diameter of the circular path is approximately 33 centimeters. If it's too small, it won't provide enough foot movement range and leg activity, and if it's too large, it may exceed the natural range of motion and become uncomfortable. In addition to rotating around the center of the circular path T, each pedal 1 can also freely rotate around its own axis corresponding to a lateral direction, allowing the foot angle to adapt to the constantly changing foot position during the user's rotation. In the typical usage, the seat 2 is adjusted to an appropriate position so that when the pedal 1 rotates to the farthest position from the seat 2 (near the location of the right pedal in the figure), the user's legs are almost fully extended. Conversely, when the pedal 1 rotates to the nearest position to the seat 2 (near the location of the left pedal in the figure), the user's legs exhibit the maximum bent position throughout the cycle, with the thighs and knees almost lifted to the highest position. For example, the left thigh is raised approximately 37 degrees, and the inner side of the left knee joint is approximately 67 degrees, as shown in the figure. The degree of thigh elevation and knee flexion may be somewhat challenging for individuals with lower physical fitness levels or restricted leg mobility. Additionally, depending on the user's body size, the raised thighs may press against the abdomen, causing discomfort.

U.S. Pat. No. 7,713,176 discloses an exercise apparatus that allows users to perform leg exercises in a seated position. The equipment is equipped with the two pedals in front of the seat, and each pedal is connected to the front frame via a parallel four-bar linkage mechanism, allowing for a nearly linear reciprocating motion along a predetermined track, with the pedal angle remaining constant, oriented upward and backward for the user to pedal. Furthermore, the two pedals are interconnected and move in opposite directions. When one pedal descends forward and downward, the other pedal rises backward and upward. With this design, users can engage in alternating leg exercises and control the depth of each pedal press and the height of the lift without requiring the user to forcefully lift the thighs or flex the knees. However, when one pedal rises lower, the other pedal also descends proportionally, directly shortening the exercise range, which may lead to insufficient leg movement. Additionally, the user's legs repetitively extend forward and flex backward, similar to pedaling on a traditional bicycle, where the feet and knees always rise and descend together, resulting in a relatively monotonous motion.

Several exercise equipment option on the market enable similar pedaling exercises in a seated position. However, many of these devices have their mechanical components extending between the seat's underside and the front, such as a crank assembly positioned under the seat and the two connecting rods connecting the crank assembly to the two pedals in front of the seat. This design requires users to cross the connecting rods when preparing for exercise by sitting on the seat and when finishing the exercise and leaving the seat. This can be inconvenient and poses a risk of tripping over the connecting rods.

SUMMARY OF THE INVENTION

The present invention aims to address the issues of the prior art mentioned above. The main objective is to provide a recumbent exercise apparatus that allows a user to perform leg exercises in a seated position. During these leg exercises, the user performs a relatively gentle thigh elevation and degree of knee flexion while also providing sufficient foot movement range and leg activity. This design combines low exercise difficulty with high exercise effectiveness.

Another objective of the present invention is to provide a recumbent exercise apparatus that allows users to perform leg exercises in a seated position. During these leg exercises, the user's leg movements are natural and smooth, distinct from the monotonous repetitive extension, flexion, and the simultaneous elevation and descent of the feet and knees found in prior art.

Another objective of the present invention is to provide a recumbent exercise apparatus that allows users to perform leg exercises in a seated position. The structure of the movement mechanism is compact, and when users are getting ready for exercise, sitting on the seat, and finishing the exercise to leave the seat, there is no need to cross any components of the movement mechanism, making it more convenient and safe.

Another objective of the present invention is to provide a recumbent exercise apparatus that allows users to perform leg exercises in a seated position. Simultaneously, the users can choose to engage in coordinated hand movements during the leg exercises, enhancing the overall effectiveness of the workout.

In order to achieve the above objectives, the present invention provides a recumbent exercise apparatus that allows a user to perform a leg exercises in a seated position. The apparatus comprises a frame; a seat disposed on the frame to support the user in a fixed position; and a movement mechanism movably arranged on the frame and has a left pedal and a right pedal located in front of the seat for the user to step on with both feet respectively. Each pedal having a toe end, a heel end, and a middle portion located between the toe end and the heel end. When performing the leg exercise, the middle portion of each pedal cyclically displaces relative to the frame along a predetermined pedal exercise path based on the guidance of the movement mechanism. Additionally, an elevation angle between the toe end and the heel end cyclically changes in a predetermined manner. The predetermined pedal exercise path is located on a vertical plane defined by a vertical and longitudinal directions of the frame, having a highest position, a lowest position, a frontmost position, a rearmost position, a maximum elevation position and a minimum elevation position. The maximum elevation position is located within a path from the highest position to the lowest position while passing through the frontmost position, and the minimum elevation position is located within a path from the lowest position to the highest position while passing through the rearmost position. Wherein the toe end of each pedal remains higher than the heel end; during the middle portion moving from the maximum elevation position to the minimum elevation position along the predetermined pedal exercise path, the elevation angle of the toe end relative to the heel end decreases gradually. In addition, during the middle portion moving from the minimum elevation position to the maximum elevation position along the predetermined pedal exercise path, the elevation angle of the toe end relative to the heel end increases gradually.

Preferably, the distance of the predetermined pedal exercise path from the rearmost position to the highest position is greater than the distance from the highest position to the frontmost position.

Preferably, the height difference between the highest and the lowest positions of the predetermined pedal exercise path in the vertical direction is smaller than the difference between the frontmost and the rearmost positions in the longitudinal direction, and the predetermined pedal exercise path has a major axis with a relatively higher front end and a relatively lower rear end.

Preferably, the distance between the maximum elevation position and the frontmost position of the predetermined pedal exercise path is smaller than the distance between the maximum elevation position and the highest position, as well as smaller than the distance between the maximum elevation position and the lowest position. Similarly, the distance between the minimum elevation position and the rearmost position of the predetermined pedal exercise path is smaller than the distance between the minimum elevation position and the highest position, as well as smaller than the distance between the minimum elevation position and the lowest position.

Preferably, the maximum elevation position of the predetermined pedal exercise path is located between the frontmost position and the lowest position, and the minimum elevation position is located between the rearmost position and the highest position.

Preferably, the movement mechanism includes a left first connecting rod, a right first connecting rod, a left second connecting rod and a right second connecting rod, all positioned in front of the seat. Each first connecting rod comprises a surrounding portion, a first reciprocating portion and a first pivoting portion. The surrounding portion is restricted to moving along a circular path relative to the frame. The first reciprocating portion is restricted to moving along a first reciprocating path relative to the frame. Each second connecting rod comprises a second reciprocating portion and a second pivoting portion. The second reciprocating portion is restricted to moving along a second reciprocating path relative to the frame, and the second pivoting portion is pivotally connected to the first pivoting portion of the corresponding first connecting rod. When the surrounding portions of the first connecting rods rotate one circle along the circular path, the first reciprocating portions of the first connecting rods and the second reciprocating portions of the second connecting rods reciprocate once along the first reciprocating path and the second reciprocating path respectively. Additionally, the first pivoting portions of the first connecting rods and the second pivoting portions of the second connecting rods rotate one circle along a closed path. The change in a relative angle of the two ends of each second connecting rod is smaller than that of the two ends of each first connecting rod; the left and right pedals are respectively mounted on the left and right second connecting rods.

Preferably, each first connecting rod has a front end and a rear end, the surrounding portion is located at the front end, the first pivoting portion is located at the rear end, and the first reciprocating portion is located between the front end and the rear end. Each second connecting rod has a front end and a rear end, the second reciprocating portion is located at the front end, and the second pivoting portion is located behind the second reciprocating portion; and each pedal is positioned on a rear half of the corresponding second connecting rod.

Preferably, the first reciprocating path has a relatively higher front end and a relatively lower rear end; the closed path has a major axis with a relatively higher front end and a relatively lower rear end; the second reciprocating portion of each the second connecting rod is located higher than the second pivoting portion. In addition, wherein the second reciprocating path has a relatively higher front end and a relatively lower rear end. In a side view, the first reciprocating path intersects with an enclosed range of at least one of circular path and the closed path, and similarly, the second reciprocating path intersects with an enclosed range of at least one of the circular path and the closed path.

Preferably, the movement mechanism includes a left crank arm, a right crank arm, a left first swing arm, a right first swing arm, a left second swing arm and a right second swing arm, all positioned in front of the seat; each crank arm has an inner end and an outer end. The inner ends of the left and right crank arms are pivotally connected to the frame according to a first axis. The outer ends of the left and right crank arms are 180 degrees opposite to each other with the first axis as a center, and are respectively pivoted to the surrounding portion of the left and right first connecting rods. Each first swing arm has an axis end and a swing end. The axis ends of the left and right first swing arms are respectively pivoted to the frame according to a second axis. The swing ends of the left and right first swing arms are respectively pivoted to the first reciprocating portions of the left and right first connecting rods. Similarly, each second swing arm has an axis end and a swing end. The axis ends of the left and right second swing arms are respectively pivoted to the frame according to the second axis. The swing ends of the left and right second swing arms are respectively pivoted to the second reciprocating portions of the left and right second connecting rods. Both the first axis and the second axis correspond to a lateral direction of the frame.

Preferably, the movement mechanism includes a left lever and a right lever, the left and right levers are respectively connected to the left and right first swing arms or respectively connected to the left and right second swing arms. Each lever has a handle for the user to grasp; the swing end of each first swing arm and the swing end of each second swing arm are both lower than the second axis, and each handle is higher than the second axis.

DETAILED DESCRIPTION

Figure 1:
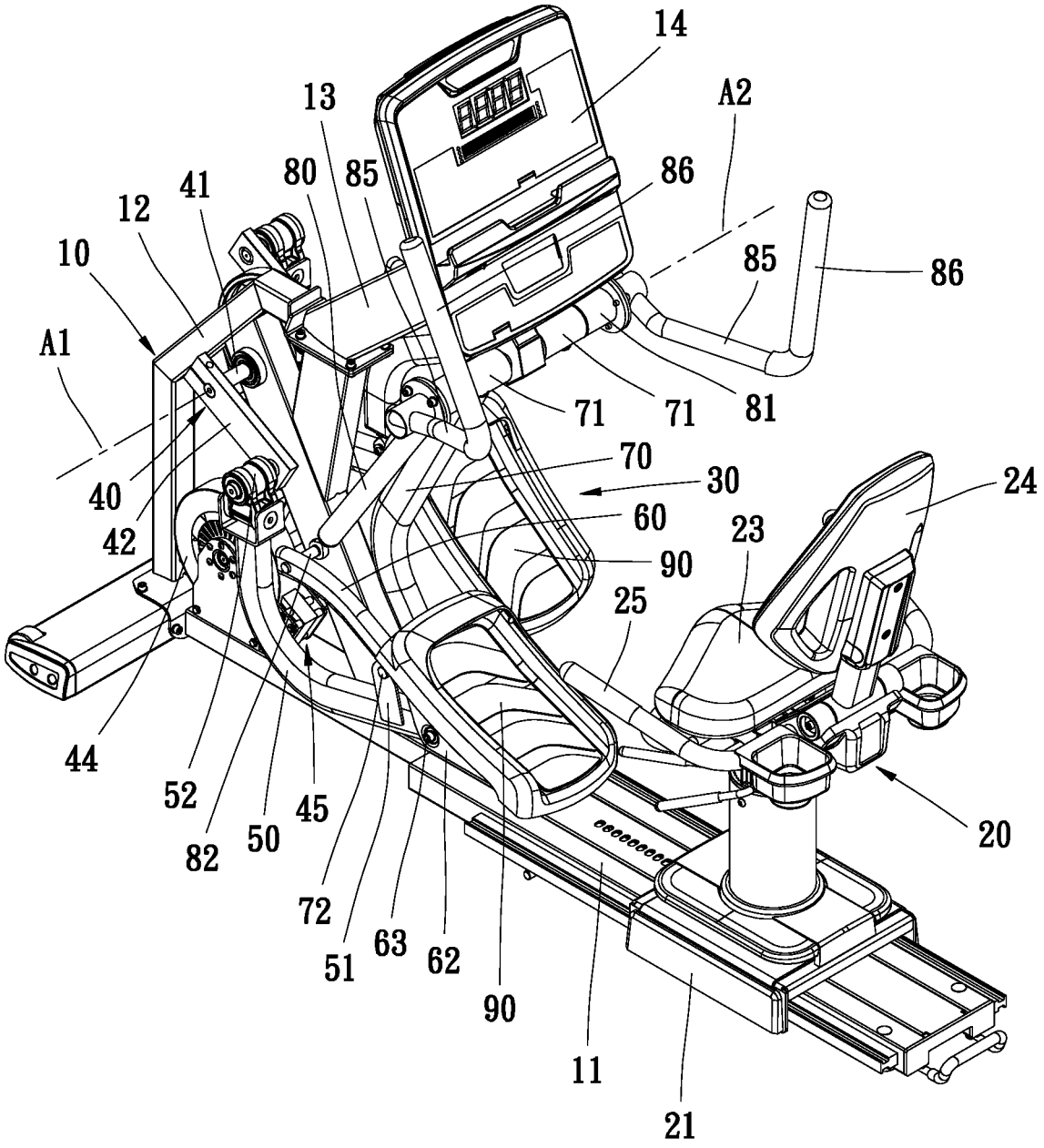
FIG. 1 is a perspective view of a preferred embodiment of the present invention.

The directional references, such as front, back, left, right, up, and down, provided in the following explanations are generally based on the user's directional perception when using the exercise apparatus of the present invention in a normal manner. For instance, front and back correspond to the direction the user is facing and the opposite direction respectively, during exercise. Left and right correspond to the user's left and right sides during exercise. The definitions of the longitudinal (front-back axial) direction, lateral (left-right axial) direction, and vertical (the up-down axial) direction of the exercise apparatus remain consistent based on the principles outlined above.

Referring to FIG. 1 to FIG. 4. In a preferred embodiment of the present invention, a recumbent exercise apparatus that allows a user to perform specific leg exercises (and optional hand exercises) in a seated position. The exercise apparatus comprises a frame 10, a seat assembly 20 located at the rear of the frame 10, and a movement mechanism 30 located at a front portion of the frame 10.

The frame 10 can be stably rested on a horizontal support surface (e.g., the ground) to serve as the installation foundation for components such as the seat assembly 20 and the movement mechanism 30. It comprises a base 11 that can be flatly placed on the support surface, a bracket 12 fixed to the front half of the base 11, and a pillar 13 extending upward and backward from the top of the bracket 12. The top of the pillar 13 is equipped with a console 14. In this embodiment, the rear portion of the base 11 forms the rear part of the frame 10, while the remaining part forms the front portion of the frame 10, including the bracket 12 and the pillar 13.

Figure 2:
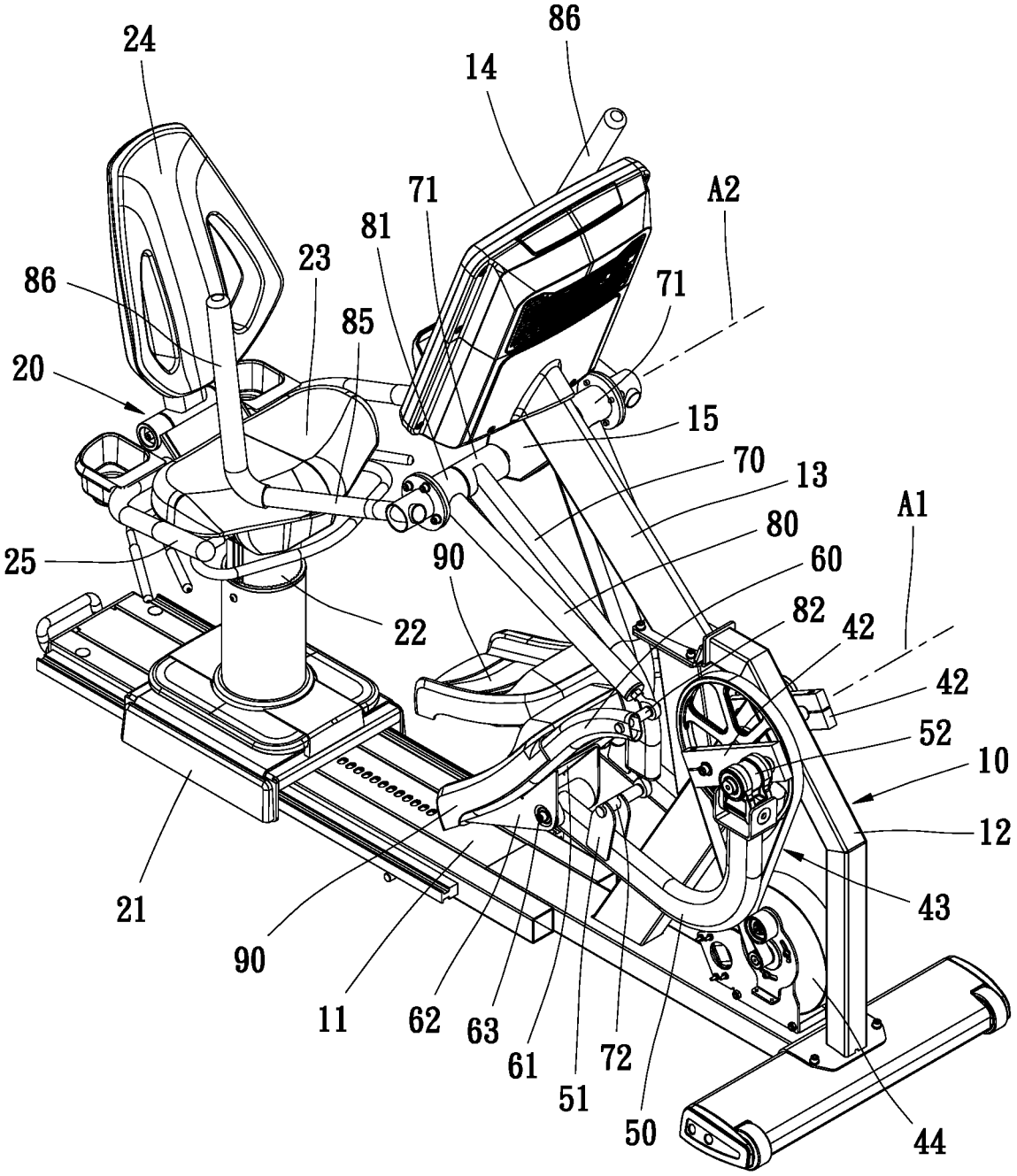
FIG. 2 is another perspective view of a preferred embodiment corresponding to the state shown in FIG. 1.
Figure 3:
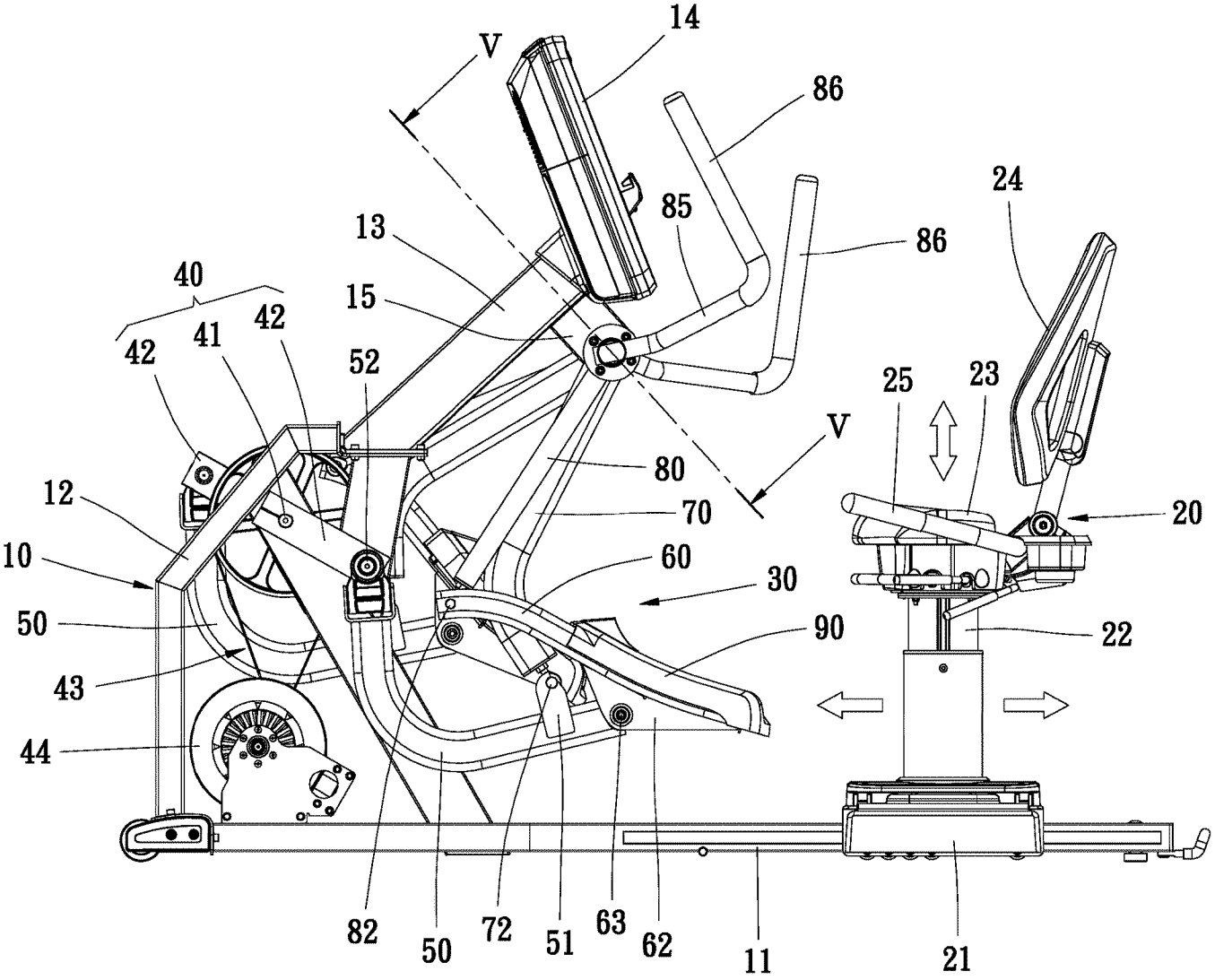
FIG. 3 is a left view of a preferred embodiment corresponding to the state shown in FIG. 1.
Figure 4:
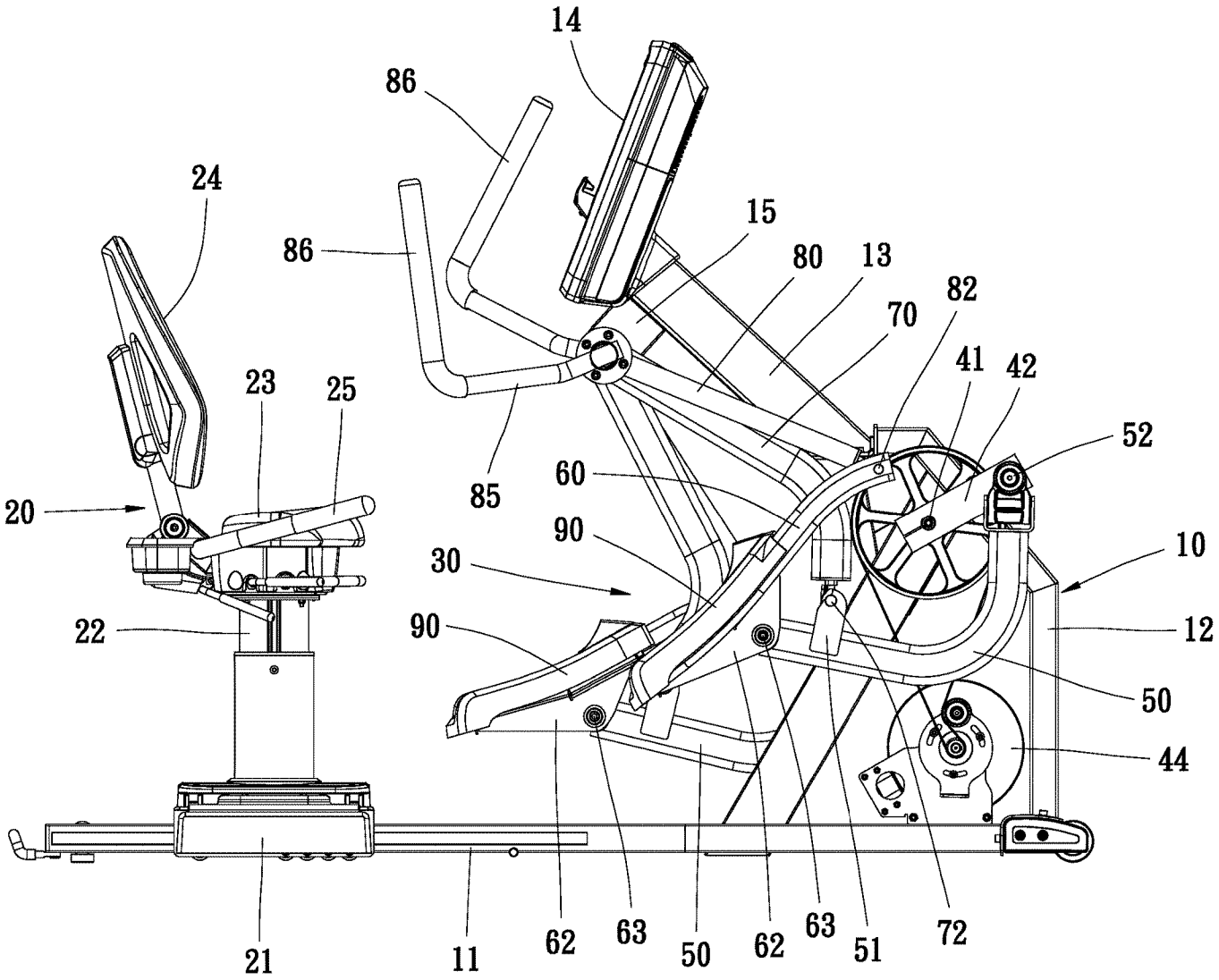
FIG. 4 is a right view of a preferred embodiment corresponding to the state shown in FIG. 1.

The seat assembly 20 comprises a sliding seat 21 positioned at the rear half of the base 11, a lift seat 22 placed on the sliding seat 21, a seat 23 positioned at the top of the lift seat 22, a chair back 24 located behind and above the seat 23, a left handle 25 and a right handle 25 provided on both sides of the seat 23, respectively. The sliding seat 21 can horizontally slide along the longitudinal axis on the rear half of the base 11, and allowing it to be located at a selected position within an adjustable range. Similarly, the lift seat 22 can vertically slide along the vertical axis on the sliding seat 21 and be located at a selected position within an adjustable range. The seat 23 allows the user to sit facing forward, supporting the user in a fixed position for leg exercises. The user can adjust the horizontal and vertical positions of the seat 23 according to their personal conditions. The chair back 24 provides back support for the user sitting on the seat 23, and the user can adjust the angle of the chair back 24 base on their personal preferences. The left and right handles 25, fixed relative to the seat 23, provide grip for the user's hands during leg exercises, aiding to stabilize the body and facilitate leg exertion. When the user is preparing to sit on the seat 23 or getting up from the seat 23, as shown in FIG. 1 and FIG. 2, the seat 23 (along with the chair back 24 and handles 25) can be horizontally rotated by 90 degrees according to personal needs. This allows the user, especially the elderly, those with larger body sizes, or limited mobility, to sit or stand on the left or right side of the exercise apparatus, providing greater convenience. Additionally, when necessary, the seat assembly 20 can be moved backward to detach from the base 11, allowing wheelchair users to enter the corresponding area from the rear. After locking the wheels of the wheelchair, the users can directly sit on the wheelchair to engage in leg exercises (and hand exercises). The aforementioned functions of the seat assembly 20 are known in the prior art. For example, products like "StepOne™ Recumbent Stepper" produced by the American company SCIFIT (one of the products corresponding to U.S. Pat. No. 7,713,176) have similar functionalities. Therefore, detailed explanations of its specific structure and operation are omitted The movement mechanism 30 is movably mounted at the front portion of the frame 10, including a crank assembly 40, a left first connecting rod 50, a right first connecting rod 50, a left second connecting rod 60, a right second connecting rod 60, a left first swing arm 70, a right first swing arm 70, a left second swing arm 80, a right second swing arm 80, a left lever 85, a right lever 85, a left pedal 90 and a right pedal 90. The overall structure is symmetrically arranged, with the left and right parts respectively located on the left and right sides of the frame 10, corresponding to the left and right sides of the user's body midline when sitting on the seat 23. Unless the seat assembly 20 is excessively moved forward, all components of the movement mechanism 30 are positioned in front of the seat 23 during normal use. Therefore, when the user enters or exits between the movement mechanism 30 and the seat 23 before or after exercise (including rotating the seat 23 horizontally by 90 degrees), there is no need to cross over any components of the movement mechanism 30, which makes it more convenient and safe.

The crank assembly 40 includes a crankshaft 41, a left crank arm 42 and a right crank arm 42. The crankshaft 41 is pivotally mounted at a predetermined position near the top of the frame 12, allowing it to rotate in place. Its axis (referred to as the first axis) A1 corresponds to a lateral direction, and its left and right ends extend from the left and right sides of the frame 12 respectively. Each crank arm 42 has an inner end and an outer end. The inner ends of the left and right crank arms 42 are fixedly connected to respective the left and right ends of the crankshaft 41, being pivotally connected to the frame 12 according to the first axis A1. This arrangement enables the outer ends of each crank arm 42 to displace along a circular path T1 around the first axis A1 relative to the frame 10 (refer to FIG. 6). Additionally, the outer ends of the two crank arms 42 are positioned 180 degrees opposite to each other with the first axis A1 as a center. This configuration ensures that when one moves upward and forward, the other one moves downward and backward at the same angular velocity, and so on.

Each first connecting rod 50 has a front end and a rear end, with a pair of protrusions 51 located between the front end and the rear end. The front end of each first connecting rod 50 is pivotally connected to the outer end of the corresponding crank arm 42 through a pivot axis 52 corresponding to the lateral direction. This arrangement forms a surrounding portion at the front end of each first connecting rod 50, restricting its displacement relative to the frame 10 to the circular path T1. In this embodiment, the connection structure between the first connecting rod 50 and the crank arm 42 is similar to a universal joint, designed to absorb geometric tolerances such as parallelism between them.

Each second connecting rod 60 has a front end and a rear end, and positioned on the inner side of a rear half of the second connecting rod, a support plate 61 is fixedly connected (refer to FIG. 2). A side plate 62 extends downward from the left and right sides of the support plate 61, with the bottom ends of the two side plates 62 can be respectively positioned at the left and right sides of the rear end of the corresponding first connecting rod 50, completing the pivot connection through a pivot axis 63 corresponding to the lateral direction. In this embodiment, the rear end of each first connecting rod 50 forms a first pivoting portion, and the bottom end of the side plates 62 of each second connecting rod 60 forms a second pivoting portion. The first pivoting portion and the second pivoting portion move in synchrony.

Figure 5:
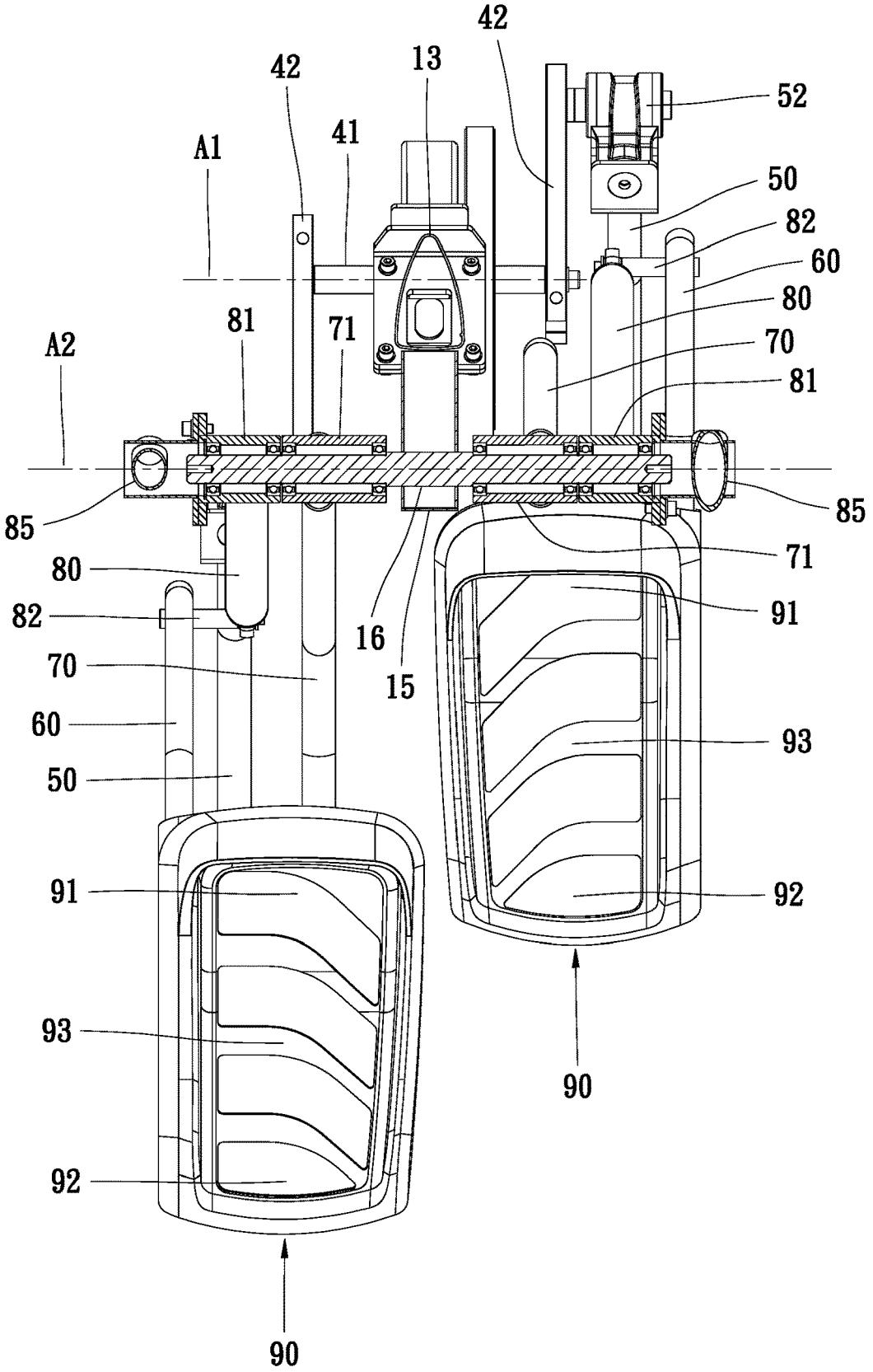
FIG. 5 is a sectional view along line V-V in FIG. 3.

Each first swing arm 70 has an axis end (top end in this embodiment) and a swing end (bottom end in this embodiment). The axis end is equipped with a shaft sleeve 71 and is pivoted at a predetermined position near the top of the pillar 13 based on a second axis A2 corresponding to the lateral direction, allowing the swing end to reciprocate. Similarly, each second swing arm 80 has an axis end (top end in this embodiment) and a swing end (bottom end in this embodiment). The axis end is equipped with a shaft sleeve 81 and is pivoted at a predetermined position near the top of the pillar 13 based on the second axis A2, allowing the swing end to reciprocate. In this embodiment, as part of the front portion of the frame 10, a hanger 15 is fixedly connected to a position near the top of the pillar 13. Additionally, a shaft rod 16 horizontally passes through and is fixedly connected to the hanger 15, as shown in FIG. 5. The axis of the shaft rod 16 corresponds to the second axis A2. The shaft sleeves 71 of the left and right first swing arms 70 can be separately pivotally mounted on the left and right halves of the shaft rod 16 through a bearing (not labeled in the figure) and are positioned relatively close to the hanger 15. Similarly, the shaft sleeves 81 of the left and right second swing arms 80 are separately pivotally mounted on the left and right halves of the shaft rod 16 through a bearing (not labeled in the figure) and are positioned relatively away from the hanger 15. Additionally, the shaft sleeves 81 of the second swing arms 80 are positioned on the outside of the shaft sleeves 71 of the first swing arms 70 in parallel. The swing end of each first swing arm 70 is pivotally connected to the top of the protrusions 51 of the corresponding first connecting rod 50 through a pivot axis 72 corresponding to the lateral direction. The swing end of each second swing arm 80 is pivotally connected to the front end of the corresponding second connecting rod 60 through a pivot axis 82 corresponding to the lateral direction. The length of the first swing arm 70 (defined as the perpendicular distance from the axis-end pivot axis to the swing-end pivot axis) is not equal to the length of the second swing arm 80 (defined as before). In this embodiment, the swing radius of the first swing arm 70 is greater than the swing radius of the second swing arm 80.

The left and right levers 85 are respectively connected to the left and right second swing arms 80, causing the left lever 85 to pivot synchronously around the second axis A2 with the left second swing arm 80, and the right lever 85 to pivot synchronously around the second axis A2 with the right second swing arm 80. In this embodiment, each lever 85 has a top end and a bottom end, with the bottom end being fixedly connected to the axis end (top end) of the corresponding second swing arm 80, specifically connected on the outer side of the shaft sleeve 81. The upper half portion of each lever 85 forms a handle 86 that allows the user grip and swing back and forth. When the swing end (bottom end) of one side's second swing arm 80 swings forward, the corresponding handle 86 on the same side will swing backward accordingly. Conversely, when the swing end swings backward, the handle 86 will swing forward. In another possible embodiment of the present invention (not illustrated), the left and right levers are respectively connected to the left and right first swing arms.

Figure 6:
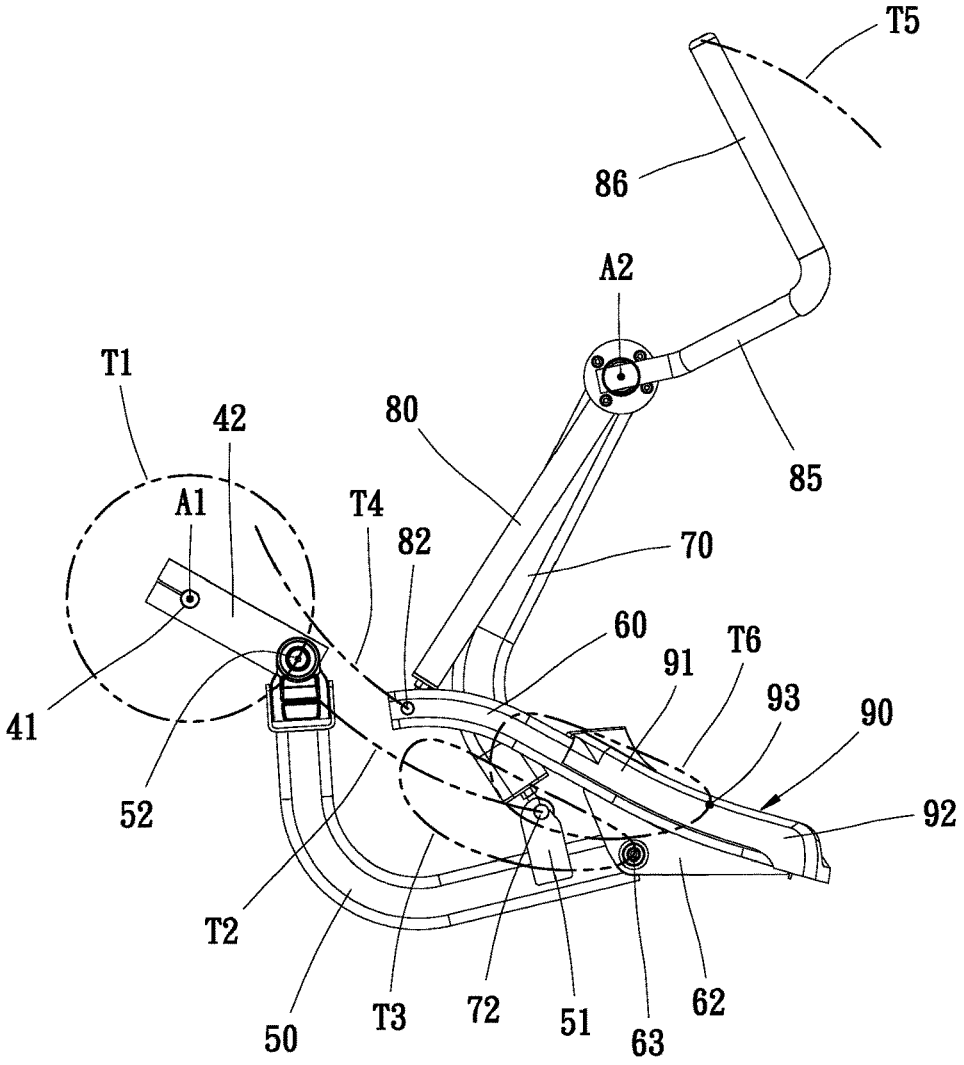
FIG. 6 is a side view illustrating of the left half of the movement mechanism in a preferred embodiment of the present invention.

The left and right pedals 90 are respectively mounted on the left and right second connecting rods 60, specifically fixedly connected above the support plate 61 on the inner side of the rear half of the second connecting rod 60. They are located relative to and between the bottom and front of the seat 23, providing for the user sitting on the seat 23 to step on with both feet. As shown in FIG. 5 and FIG. 6, each pedal 90 has a toe end 91 positioned closer to the front of the pedal, a heel end 92 at the rear, and a middle portion 93 located between the toe end 91 and the heel end 92.

Figure 7:
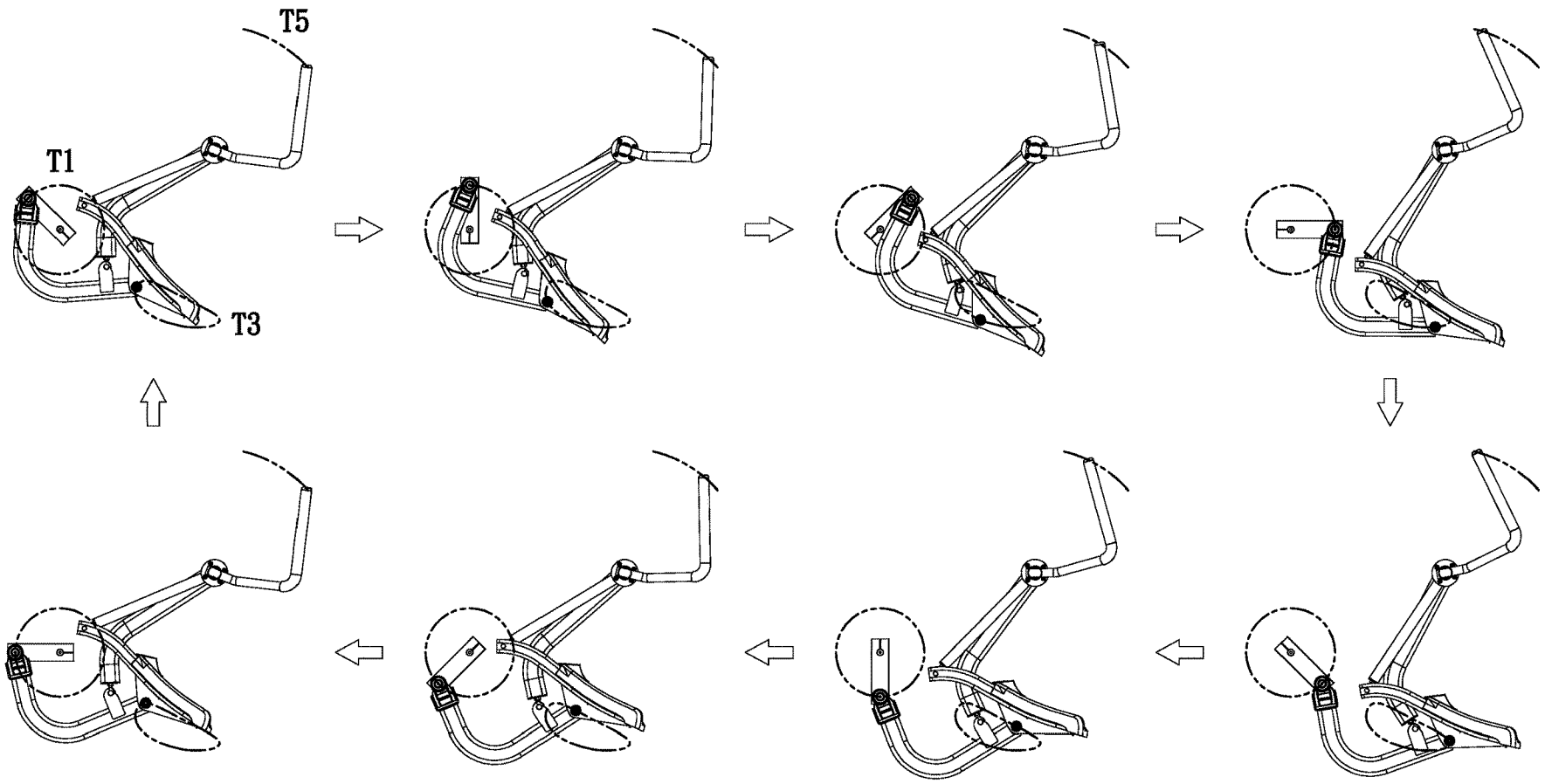
FIG. 7 illustrates the variation of the left half of the movement mechanism in a cycle period in a preferred embodiment of the present invention.

The components of the movement mechanism 30 are interlinked, and the movement of any component causes corresponding movements in other components. Refer to FIG. 6 and FIG. 7 (Note: For clarity, only the left half of the movement mechanism 30 is shown in the figures due to overlapping movement path of corresponding components in the left and right side views. For example, the outer end of the right crank arm 42 also displaces along the circular path T1 in the figure). Through the interconnected relationships of the components in the movement mechanism 30, along with the predefined dimensions and spatial positions of the components, as the front end (surrounding portion) of the first connecting rod 50 rotates one full circle along the circular path T1. The portion where the top of the protrusion 51 of the first connecting rod 50 is pivotally connected to the swing end of the first swing arm 70 reciprocates along an arc-shaped first reciprocating path T2 once. Simultaneously, the portion (pivot axis 63) where the rear end (first pivoting portion) of the first connecting rod 50 is pivotally connected to the bottom end (second pivoting portion) of the side plate 62 of the second connecting rod 60 rotates along a closed path T3 for one revolution. At the same time, the portion (pivot axis 82) where the front end of the second connecting rod 60 is pivotally connected to the swing end of the second swing arm 80 reciprocates along an arc-shaped second reciprocating path T4 once. Meanwhile, the handle 86, synchronously moving with the second connecting rod 60, reciprocates along an arc-shaped handle movement path T5 once. Throughout this process, the relative change in angle between the front and rear ends of the first connecting rod 50 is approximately 50 degrees (Note: In one cycle, the maximum inclination angle of the front end of the first connecting rod 50 relative to the rear end is about 60 degrees, and the minimum is about 10 degrees). The relative change in angle between the front and rear ends of the second connecting rod 60 is approximately 30 degrees, which is smaller than the angle change of the first connecting rod 50. In this embodiment, the top ends of the protrusions 51 of each first connecting rod 50 form a first reciprocating portion, restricted to displacement along the first reciprocating path T2 relative to the frame 10. The front ends of each second connecting rod 60 form a second reciprocating portion, restricted to displacement along the second reciprocating path T4 relative to the frame 10.

In this way, as the respective portions of the first connecting rod 50 and the second connecting rod 60 cyclically displace or reciprocate along their respective trajectories, the middle portion 93 of the pedal 90 cyclically displaces relative to the frame 10 along a predetermined pedal exercise path T6. Moreover, an elevation angle between the toe end 91 and the heel end 92 cyclically changes in a predetermined manner (detailed explanation follows). In this embodiment, the exercise apparatus is designed to allow users with an active movement way to engage in the leg exercises for fitness. Specifically, the user must exert appropriate force while stepping on the left and right pedals 90 to drive them cyclically along the predetermined pedal exercise path T6, causing the crank assembly 40 to rotate through the motion of the first connecting rod 50. In this embodiment, as the crank assembly 40 rotates, a flywheel 44 can spin faster in place through a belt transmission mechanism 43. Additionally, there is a resistance device 45 positioned near the flywheel 44, which can apply resistance to the flywheel 44, such as an eddy current brake. The user can adjust the resistance on the flywheel 44 using the resistance device 45 through the console 14, thereby modifying the effort required for displacing the pedals 90. Depending on the user's implementation choice, the crank assembly 40 can drive the flywheel 44 to rotate in the same direction during both forward rotation (corresponding to clockwise rotation in FIG. 6) and reverse rotation (corresponding to counterclockwise rotation in FIG. 6). This means that the user will experience inertia and resistance when driving the pedals 90 in either the forward or reverse direction. Alternatively, by installing a one-way bearing between the crankshaft 41 and the belt transmission mechanism 43, the flywheel 44 will not be driven when the crank assembly 40 rotates in reverse. In this case, the user only needs to overcome the rotational resistance of the flywheel 44 when driving the pedals 90 in the forward direction and can freely decelerate and stop as desired.

In another possible embodiment of the present invention, the exercise apparatus is designed to allow users with a passive movement way to engage in the leg exercises for rehabilitation. In other words, the user's legs, positioned on the left and right pedals 90, can be automatically moved cyclically along the predetermined pedal exercise path T6 by the pedals 90. This movement induces passive ROM exercises, including knee and hip joint movements. In a specific implementation, a motor can be used to replace the flywheel 44. The output torque of the motor, reversed by the belt transmission mechanism 43, drives the crank assembly 40 to rotate at a slower speed, thereby displacing the pedals 90 along the predetermined pedal exercise path T6 in a cyclic manner. In another possible embodiment of the present invention, the exercise apparatus can be used for performing the leg exercises in either an active or passive mode. Wherein, each of the pedal 90 may be equipped with straps for appropriately restraining the user's feet.

Figure 8:
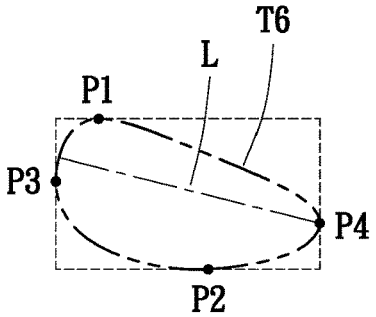
FIG. 8 illustrates the predetermined pedal exercise path of the middle portion of the pedal in a preferred embodiment of the present invention.

The first axis A1 and the second axis A2 between the movement mechanism 30 and the frame 10 correspond to the lateral direction of the frame 10. Therefore, the circular path T1, the first reciprocating path T2, the closed path T3, the second reciprocating path T4, the handle movement path T5, and the predetermined pedal exercise path T6 are all located on a vertical plane defined by a vertical and longitudinal directions of the frame 10. In other words, various parts of the movement mechanism 30 only undergo vertical and longitudinal displacements, without any lateral movement. As shown in FIG. 8, the predetermined pedal exercise path T6 is somewhat oval-shaped, and having a highest position P1, a lowest position P2, a frontmost position P3, and a rearmost position P4. In this embodiment, the height difference between the highest position P1 and the lowest position P2 along the vertical axis is approximately 17 centimeters, while the front-back difference between the frontmost position P3 and the rearmost position P4 along the horizontal axis is approximately 30 centimeters. The height difference is smaller than the front-back difference. Additionally, the predetermined pedal exercise path T6 has a major axis L (Note: the major axis is defined as the direction connecting the two points farthest apart on the closed path), with the major axis L having a front end (left end in Figure) and a rear end (right end in Figure). While the front end is higher than the rear end, but the relative elevation is smaller than 45 degrees, approximately 14 degrees in this embodiment. In addition, the distance (P4-P1) of the predetermined pedal exercise path T6 from the rearmost position P4 to the highest position P1 is greater than the distance (P1-P3) from the highest position P1 to the frontmost position P3. The distance (P3-P2) of the predetermined pedal exercise path T6 from the frontmost position P3 to the rearward and downward to lowest position P2 is greater than the distance (P2-P4) from the lowest position P2 rearward and upward to the rearmost position P4.

Figure 9:
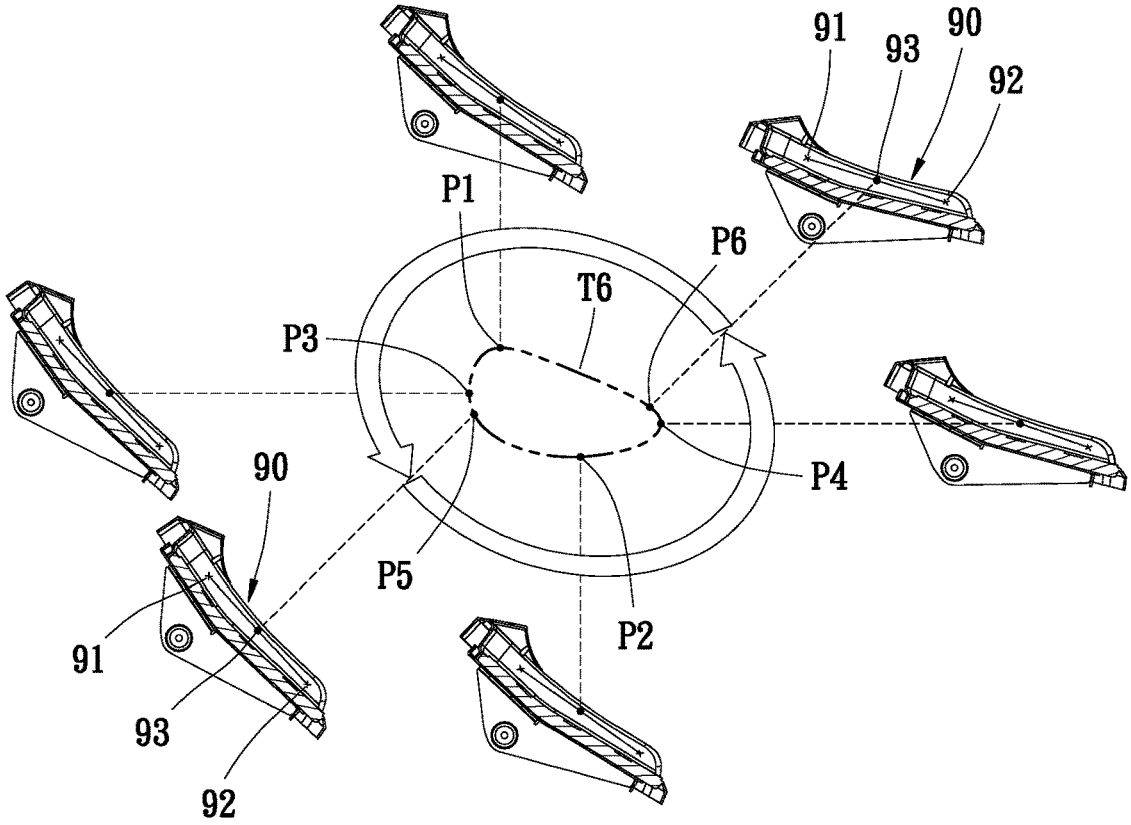
FIG. 9 schematically illustrates the change in pedal elevation angle when the middle portion of the pedal displaces along the predetermined pedal exercise path.

Since the left and right pedals 90 are respectively mounted on the left and right second connecting rods 60, when the middle portion 93 of each pedal 90 cyclically moving along the predetermined pedal exercise path T6, a relative angle between its front and rear ends will be continuously changed along with the corresponding second connecting rod 60. The toe end 91 of each pedal 90 is always higher than the heel end 92. Additionally, as shown in FIG. 9, during one complete cycle of rotation of the middle portion 93 of the pedal 90 along the predetermined pedal exercise path T6, the elevation of the toe end 91 relative to the heel end 92 gradually increases and then decreases. In particular, the predetermined pedal exercise path T6 has a maximum elevation position P5 and a minimum elevation position P6. The maximum elevation position P5 is located within the path from the highest position P1 to the lowest position P2 while passing through the frontmost position P3, and the minimum elevation position P6 is located within the path from the lowest position P2 to the highest position P1 while passing through the rearmost position P4. When the middle portion 93 of the pedal 90 is located at the maximum elevation position P5, an elevation angle of the toe end 91 relative to the heel end 92, termed as the maximum elevation angle, is within the range of greater than 30 degrees and smaller than 60 degrees, approximately 48 degrees in this embodiment. Conversely, when the middle portion 93 of the pedal 90 is located at the minimum elevation position P6, the elevation angle of the toe end 91 relative to the heel end 92, termed as the minimum elevation angle, is within the range of greater than 0 degrees and smaller than 30 degrees, approximately 18 degrees in this embodiment. The angular difference between the maximum and minimum elevation angles is greater than 15 degrees and smaller than 45 degrees, approximately 30 degrees in this embodiment, equal to the angular variation of the second connecting rod 60 relative to the frame 10. Imaginatively, during the process in which the middle portion 93 moving from the maximum elevation position P5 to the minimum elevation position P6 along the predetermined pedal exercise path T6, the elevation angle of the toe end 91 relative to the heel end 92 decreases gradually. In the preceding process, as the middle portion 93 moving from the minimum elevation position P6 to the maximum elevation position P5 along the predetermined pedal exercise path T6, the elevation angle of the toe end 91 relative to the heel end 92 increases gradually. As a side note, the elevation angle of the toe end 91 relative to the heel end 92 when the pedal 90 is located at the highest position P1 is approximately 36 degrees, at the frontmost position P3 is approximately 47 degrees, at the lowest position P2 is approximately 36 degrees, and at the rearmost position P4 is approximately 19 degrees.

Preferably, the distance between the maximum elevation position P5 and the frontmost position P3 is smaller than the distance between the maximum elevation position P5 and the highest position P1, and also smaller than the distance between the maximum elevation position P5 and the lowest position P2. In essence, the maximum elevation position P5 is relatively closer to the frontmost position P3 and relatively farther from the highest position P1 and the lowest position P2. Additionally, the distance between the minimum elevation position P6 and the rearmost position P4 is smaller than the distance between the minimum elevation position P6 and the highest position P1, and also smaller than the distance between the minimum elevation position P6 and the lowest position P2. In essence, the minimum elevation position P6 is relatively closer to the rearmost position P4 and relatively farther from the highest position P1 and the lowest position P2. In this embodiment, the maximum elevation position P5 is located between the frontmost position P3 and P2, and the minimum elevation position P6 is located between the rearmost position P4 and the highest position P1. Moreover, the path from the minimum elevation position P6 to the forward and upward direction towards the highest position P1 approximately forms a straight line.

Figure 10:
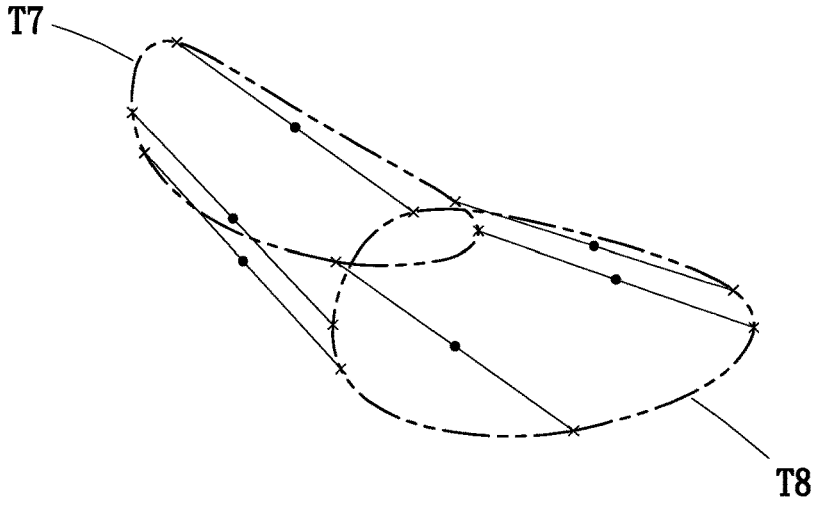
FIG. 10 illustrates the exercise path of the toe end and the heel end in a preferred embodiment of the present invention.

Due to the continuous change in a relative angle of the front and rear ends of the pedal 90 during cyclically displaces, the movement path of the toe end 91 and the heel end 93 are distinct. As shown in FIG. 10, the toe end 91 cyclically displaces along a relatively elongated outline, represented by the toe movement path T7, relative to the frame 10. In contrast, the heel end 92 cyclically displaces along a relatively rounded outline, represented by the heel movement path T8, relative to the frame 10. The difference in shapes between the toe movement path T7 and the heel movement path T8 reflects the gradual reduction of the pedal 90's elevation angle from the maximum elevation position P5 to the minimum elevation position P6 and the gradual increase from the minimum elevation position P6 to the previously mentioned maximum elevation position P5. Similar to the predetermined movement path T6, the front-back difference of the toe movement path T7 and the heel movement path T8 is greater than the up-down difference. Furthermore, the distance from the rearmost position to the highest position is greater than the distance from the highest position to the frontmost position.

Please refer to FIG. 6 again. In order to generate the predetermined pedal exercise path T6 or a similar shape as shown in the figure, and the variation pattern of the pedal elevation angle, in this embodiment, the first reciprocating portion of the first connecting rod 50 (i.e., the top of the protrusion 51) is located between the surrounding portion (front end) and the first pivoting portion (rear end). Additionally, the first reciprocating path T2 is relatively located behind and below the center of the circular path T1, having a relatively higher front end and a relatively lower rear end. This configuration resulting in the closed path T3 having a major axis (defined as before) with a relatively higher front end and a relatively lower rear end. Simultaneously, the second reciprocating portion of the second connecting rod 60 (front end) is located forward and upward of the first and second pivoting portions, and the second reciprocating path T4 also has a relatively higher front end and a relatively lower rear end. Furthermore, in this embodiment, the swinging ends (bottom ends) of the first swing arm 70 and the second swing arm 80, which share the same axis but have different lengths, respectively guide the first reciprocating portions of the first connecting rods 50 and the second reciprocating portions of the second connecting rods 60. In a side view, the first reciprocating path T2 intersects with an enclosed range of at least of the circular path T1 and the closed path T3 (in this embodiment, the latter). Similarly, the second reciprocating path T4 intersects with an enclosed range of at least of the circular path T1 and the closed path T3 (in this embodiment, the former). Through this mechanism, the movement mechanism 30 can provide a larger or sufficient pedal path in a smaller space with a more compact structure. In another possible embodiment of the present invention (not shown), the first reciprocating portions of the first connecting rods and/or the second reciprocating portions of the second connecting rods are equipped with rollers. These rollers can reciprocate along preset guide rails on the frame, also restricted to displace on a first reciprocating path and/or a second reciprocating path. Through this structure, similar exercise paths and elevation angle variations can be achieved.

The following describes the actions and effects of users utilizing the exercise apparatus in this preferred embodiment for leg exercises (and arm exercise). As shown in FIGS. 11A through 11E, during the exercise, the user is seated facing forward on the seat 23 (Note: the seat 23 in the figure is positioned for the comfort and suitability of the user; if the seat 23 is in an inappropriate position, the user may not be able to perform the following actions correctly and comfortably). The left foot and right foot are placed on the left and right pedals 90, respectively, while the left hand and right hand typically grip the left and right handles 86, respectively. Both legs and hands coordinate to apply force, driving the respective pedals 90 and handles 86 to cyclically displace along the predetermined pedal exercise path T6 and reciprocate along the handle exercise path T5. Based on the interconnection of components in the movement mechanism 30, in general, when the left pedal 90 moves forward, the left handle 86 moves backward; simultaneously, the right pedal 90 moves backward, and the right handle 86 moves forward. This is similar to the balance of limbs when a person walks or runs. However, the user can also choose to grip the handles 25 on both sides of the seat 23 separately, performing only leg exercises. In another possible embodiment of the present invention (not shown), the exercise apparatus does not provide the functionality for arm exercises. For example, by removing the levers 85 and placing fixed handles near the corresponding positions.

Figure 11A:
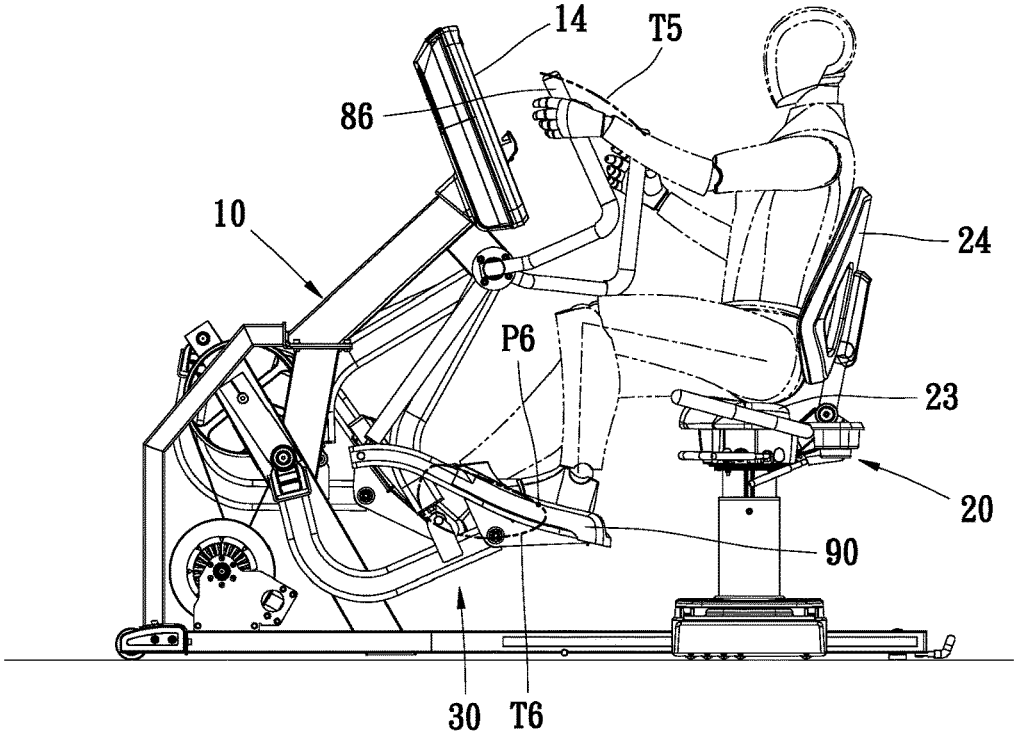
FIG. 11A illustrates a user engaging in where the left pedal located at the minimum elevation position.

In general, the user apply force to drive each pedal 90 along the predetermined pedal exercise path T6 in the positive direction. That is, the pedals 90 displace from the highest position P1 through the frontmost position P3 to the lowest position P2, and then from the lowest position P2 through the rearmost position P4 back to the highest position P1, repeating this cycle. Of course, the user may also apply force to drive each pedal 90 in the opposite direction. The sequence of FIGS. 11A, 11B, 11C, 11D, 11E (and then back to FIG. 11A) corresponds to the process of positive displacement. In FIG. 11A, the left pedal 90 is located at the minimum elevation position P6 on the predetermined pedal exercise path T6. Conversely, in FIG. 11D, the left pedal 90 is located at the maximum elevation position P5 on the pedal exercise path T6. In other words, the left pedal 90 undergoes the process from the position shown in FIG. 11A, along the predetermined pedal exercise path T6 through the positions shown in FIGS. 11B and 11C, to reach the position shown in FIG. 11D. During this process, the elevation angle of the toe end of the pedal 90 relative to the heel end increases gradually. Conversely, the left pedal 90 undergoes the process from the position shown in FIG. 11D, along the predetermined pedal exercise path T6 through the position shown in FIG. 11E, to return to the position shown in FIG. 11A. During this process, the elevation angle of the toe end of the pedal 90 relative to the heel end decreases gradually.

Figure 11B:
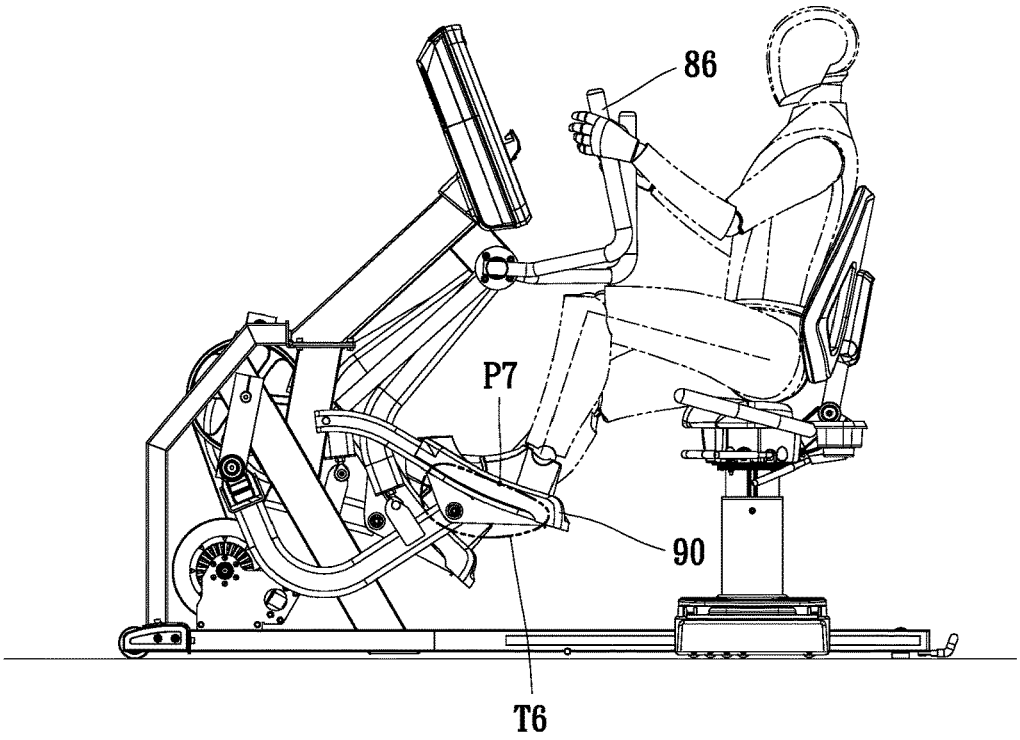
FIG. 11B is similar to FIG. 11A, but with the left pedal located at a specific location between the minimum elevation position and the highest position, where the user's left thigh raised to its highest angle.
Figure 11C:
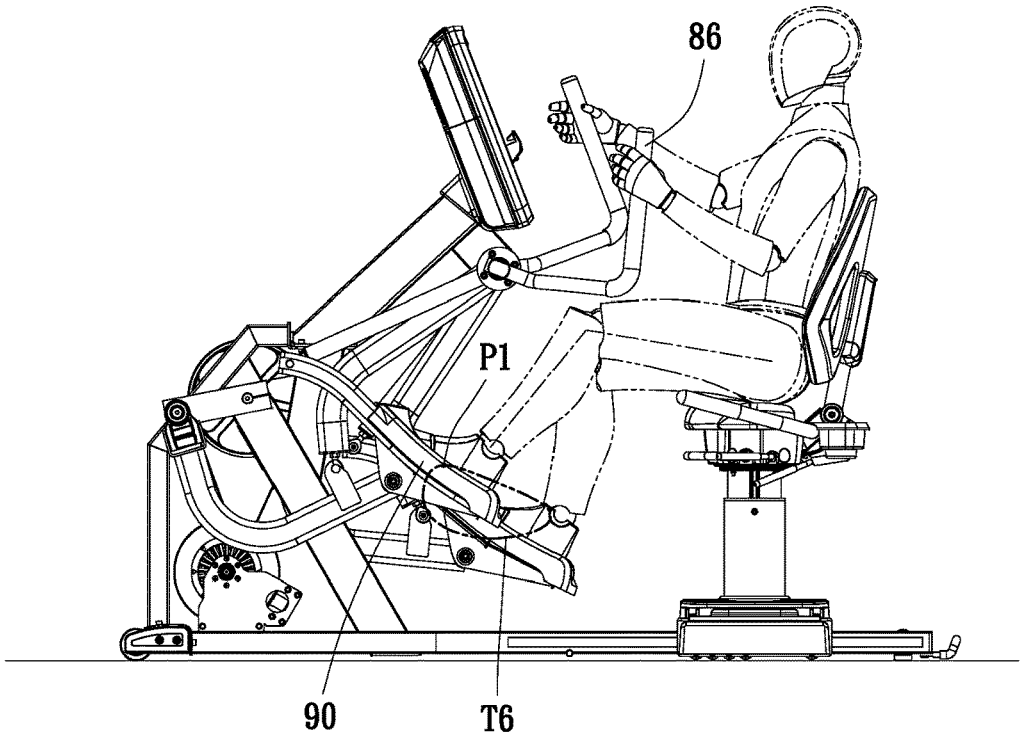
FIG. 11C is similar to FIG. 11A, but with the left pedal located at the highest position.
Figure 11D:
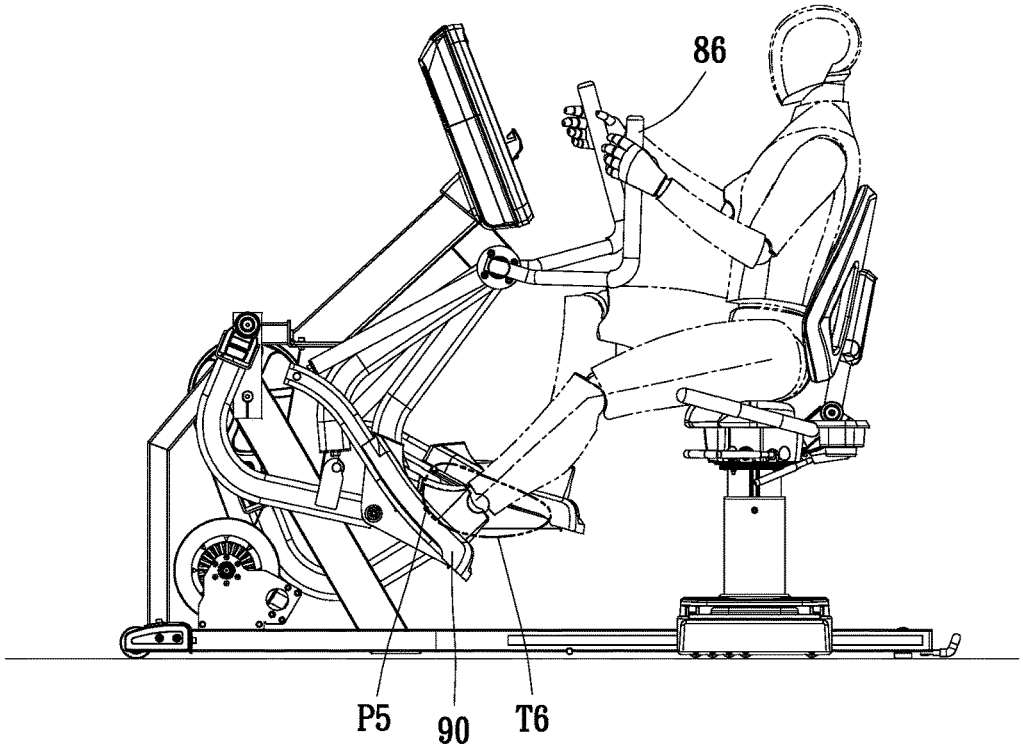
FIG. 11D is similar to FIG. 11A, but with the left pedal located at the maximum elevation position.
Figure 11E:
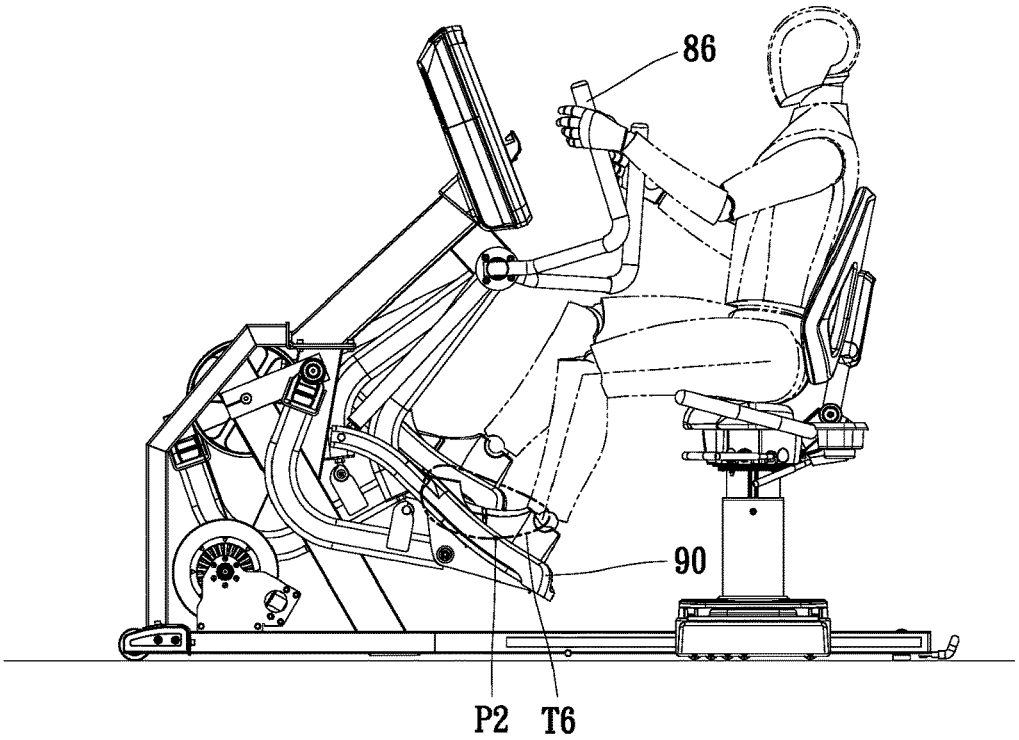
FIG. 11E is similar to FIG. 11A, but with the left pedal located at the lowest position.
Figure 12:
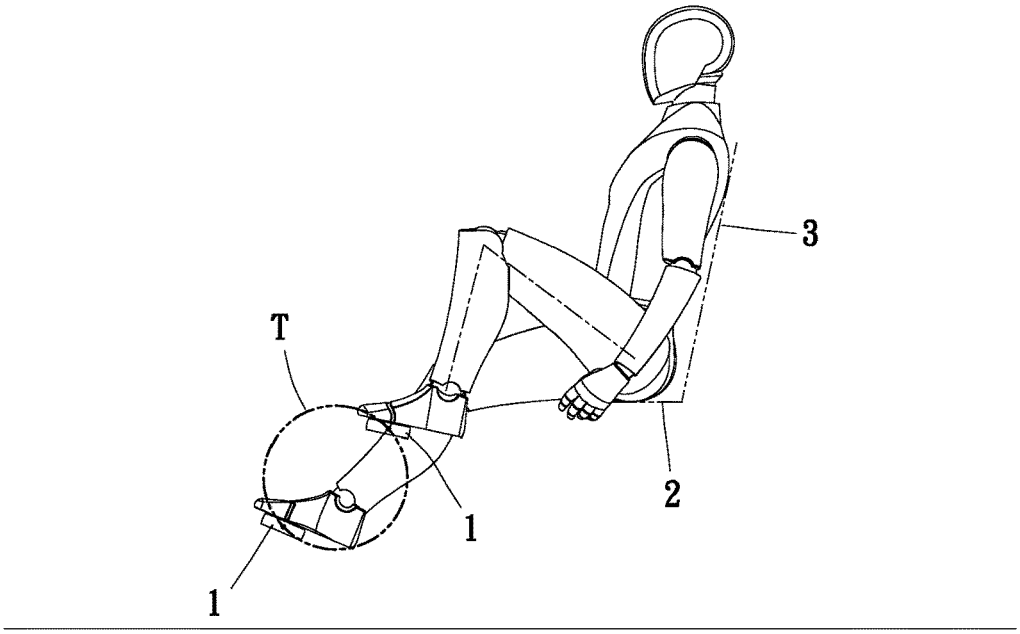
FIG. 12 illustrates that the leg movements of the human body during leg exercised using a recumbent bike, with the left thigh raised to its highest angle.

In coordination with the user's leg movements, in a general or typical usage state, when the user's left foot is flat on the left pedal 90 positioned at the minimum elevation position P6, the left thigh is usually slightly elevated (elevation angle approximately 12 degrees in FIG. 11A), and there is usually an acute angle between the left lower leg and the left thigh (approximately 80 degrees in FIG. 11A). When the user's left foot is flat on the left pedal 90 positioned at the highest position P1, the angle between the left lower leg and the left thigh is typically obtuse (approximately 120 degrees in FIG. 11C). During the process of the user's left foot moving from the minimum elevation position P6 to the forward and upward to reach the highest position P1, it passes through a specific position as shown in FIG. 11B. At this point, the user's left thigh and left knee are raised to the highest height throughout the movement (elevation angle approximately 15 degrees in FIG. 11B), and there is generally a right angle between the left lower leg and the left thigh. It is worth noting that during the stage from FIG. 11B to FIG. 11C, the user's left thigh and left knee begin to gradually lower, but the left foot continues to displace forward and upward with the left pedal 90, causing the left lower leg to swing upward relative to the left knee. After passing the highest position, the left pedal 90 continues to move away from the seat 23, meaning that the user's left foot continues to move away from the seat. Therefore, the user's left leg continues to stretch, and the elevation angle of the left foot continues to increase until the left pedal 90 reaches the maximum elevation position P5. At this position, the user's left leg is close to fully extended, and the left thigh and left knee are lowered to the lowest height throughout the movement (angle of depression approximately 12 degrees in FIG. 11D). Subsequently, the user's left leg begins to bend, the left thigh and left knee start to rise, and the elevation angle of the left foot gradually decreases until the left pedal 90 returns to the minimum elevation position P6 along the predetermined pedal exercise path T6, repeating this process continuously. Even if the user's hands do not push or pull the handle 86, because the left and right pedals 90 generally remain their relative positions on the predetermined pedal exercise path T6, there is always at least one side that can be driven by the user's force at applied any time. Coupled with the motion inertia provided by the flywheel 44, each pedal 90 can rotate smoothly and continuously. The leg movements are also applicable for the passive movement.

The above-mentioned exercise apparatus of the present invention has at least the following advantages or features:

1. During these leg exercises, the user performs a relatively gentle thigh elevation and degree of knee flexion while also providing sufficient foot movement range and leg activity. This design combines low exercise difficulty with high exercise effectiveness.

2. During these leg exercises, the user's leg movements are natural and smooth, distinct from the monotonous repetitive extension, flexion, and the simultaneous elevation and descent of the feet and knees found in prior art.

3. The structure of the movement mechanism is compact, and when users are getting ready for exercise, sitting on the seat, and finishing the exercise to leave the seat, there is no need to cross any components of the movement mechanism, making it more convenient and safe.

4. The users can choose to engage in coordinated hand movements during the leg exercises, enhancing the overall exercise effectiveness of the workout.

What is claimed is:

1. A recumbent exercise apparatus that allows a user to perform leg exercises in a seated position, comprising:

a frame;

a seat disposed on the frame to support the user's buttocks in a fixed position; and a movement mechanism movably arranged on the frame and has a left pedal and a right pedal located in front of the seat for the user to step on with both feet respectively, each pedal having a toe end, a heel end, and a middle portion located between the toe end and the heel end;

when performing the leg exercise, the middle portion of each pedal cyclically displaces relative to the frame along a predetermined pedal exercise path based on the guidance of the movement mechanism, and an elevation angle between the toe end and the heel end cyclically changes in a predetermined manner;

wherein the predetermined pedal exercise path is located on a vertical plane defined by vertical and longitudinal directions of the frame, the predetermined pedal exercise path has a major axis with a relatively higher front end and a relatively lower rear end, and having a highest position, a lowest position, a frontmost position, a rearmost position, a maximum elevation position and a minimum elevation position;

wherein the maximum elevation position is located within a path from the highest position to the lowest position while passing through the frontmost position, and the minimum elevation position is located within a path from the lowest position to the highest position while passing through the rearmost position;

wherein the toe end of each pedal remains higher than the heel end; during the middle portion moving from the maximum elevation position to the minimum elevation position along the predetermined pedal exercise path, the elevation angle of the toe end relative to the heel end decreases gradually; and during the middle portion moving from the minimum elevation position to the maximum elevation position along the predetermined pedal exercise path, the elevation angle of the toe end relative to the heel end increases gradually.

2. The recumbent exercise apparatus as claimed in claim 1, wherein the movement mechanism includes a left first connecting rod, a right first connecting rod, a left second connecting rod and a right second connecting rod, all positioned in front of the seat; each first connecting rod comprises a surrounding portion, a first reciprocating portion and a first pivoting portion, the surrounding portion is restricted to moving along a circular path relative to the frame, the first reciprocating portion is restricted to moving along a first reciprocating path relative to the frame; each second connecting rod comprises a second reciprocating portion and a second pivoting portion, the second reciprocating portion is restricted to moving along a second reciprocating path relative to the frame, and the second pivoting portion is pivotally connected to the first pivoting portion of the corresponding first connecting rod; when the surrounding portions of the first connecting rods rotate one circle along the circular path, the first reciprocating portions of the first connecting rods and the second reciprocating portions of the second connecting rods reciprocate once along the first reciprocating path and the second reciprocating path respectively, and the first pivoting portion of the first connecting rods and the second pivoting portion of the second connecting rods rotate one circle along a closed path, and an angular change of each second connecting rod is smaller than that of each first connecting rod; the left and right pedals are respectively mounted on the left and right second connecting rods.

3. The recumbent exercise apparatus as claimed in claim 2, wherein each first connecting rod has a front end and a rear end, the surrounding portion is located at the front end, the first pivoting portion is located at the rear end, and the first reciprocating portion is located between the front end and the rear end; each second connecting rod has a front end and a rear end, the second reciprocating portion is located at the front end, and the second pivoting portion is located behind the second reciprocating portion; and each pedal is positioned on a rear half of the corresponding second connecting rod.

4. The recumbent exercise apparatus as claimed in claim 3, wherein the first reciprocating path has a relatively higher front end and a relatively lower rear end; the closed path has a major axis with a relatively higher front end and a relatively lower rear end; the second reciprocating portion of each second connecting rod is located higher than the second pivoting portion; and wherein the second reciprocating path has a relatively higher front end and a relatively lower rear end; in a side view, the first reciprocating path intersects with an enclosed range of at least one of the circular path and the closed path, and the second reciprocating path also intersects with an enclosed range of at least one of the circular path and the closed path.

5. The recumbent exercise apparatus as claimed in claim 2, wherein the movement mechanism includes a left crank arm, a right crank arm, a left first swing arm, a right first swing arm, a left second swing arm and a right second swing arm, all positioned in front of the seat; each crank arm has an inner end and an outer end, the inner ends of the left and right crank arms are pivotally connected to the frame according to a first axis, the outer ends of the left and right crank arms are 180 degrees opposite to each other with the first axis as a center and are respectively pivoted to the surrounding portion of the left and right first connecting rods; each first swing arm has an axis end and a swing end, and the axis ends of the left and right first swing arms are respectively pivoted to the frame according to a second axis, the swing ends of the left and right first swing arms are respectively pivoted to the first reciprocating portion of the left and right first connecting rods; each second swing arm has an axis end and a swing end, the axis ends of the left and right second swing arms are respectively pivoted to the frame according to the second axis, the swing ends of the left and right second swing arms are respectively pivoted to the second reciprocating portion of the left and right second connecting rods; both the first axis and the second axis correspond to a lateral direction of the frame.

6. The recumbent exercise apparatus as claimed in claim 5, wherein the movement mechanism includes a left lever and a right lever, the left and right levers are respectively connected to the left and right first swing arms or respectively connected to the left and right second swing arms; each lever has a handle for the user to grasp; the swing end of each first swing arm and the swing end of each second swing arm are both lower than the second axis, and each handle is higher than the second axis.

7. The recumbent exercise apparatus as claimed in claim 1, wherein the distance of the predetermined pedal exercise path from the rearmost position to the highest position is greater than the distance from the highest position to the frontmost position.

8. The recumbent exercise apparatus as claimed in claim 1, wherein the height difference between the highest and the lowest positions of the predetermined pedal exercise path in the vertical direction is smaller than the difference between the frontmost and the rearmost positions in the longitudinal direction.

9. The recumbent exercise apparatus as claimed in claim 1, wherein the distance between the maximum elevation position and the frontmost position of the predetermined pedal exercise path is smaller than the distance between the maximum elevation position and the highest position, and also smaller than the distance between the maximum elevation position and the lowest position; and wherein the distance between the minimum elevation position and the rearmost position of the predetermined pedal exercise path is smaller than the distance between the minimum elevation position and the highest position, and also smaller than the distance between the minimum elevation position and the lowest position.

10. The recumbent exercise apparatus as claimed in claim 1, wherein the maximum elevation position of the predetermined pedal exercise path is located between the frontmost position and the lowest position, and the minimum elevation position is located between the rearmost position and the highest position.

11. A recumbent exercise apparatus that allows a user to perform leg exercises in a seated position, comprising:

a frame having a front portion;

a seat located behind the front portion of the frame to support the user's buttocks in a fixed position; and a movement mechanism movably mounted at the front portion of the frame, including a left first connecting rod, a right first connecting rod, a left second connecting rod, a right second connecting rod, a left pedal and a right pedal, wherein:

each first connecting rod comprises a surrounding portion, a first reciprocating portion and a first pivoting portion, the surrounding portion is restricted to moving along a circular path relative to the frame, and the first reciprocating portion is restricted to moving along a first reciprocating path relative to the frame;

each second connecting rod comprises a second reciprocating portion and a second pivoting portion, the second reciprocating portion is restricted to moving along a second reciprocating path relative to the frame, and the second pivoting portion is pivotally connected to the first pivoting portion of the corresponding first connecting rod; when the surrounding portions of the first connecting rods rotate one circle along the circular path, the first reciprocating portions of the first connecting rods and the second reciprocating portions of the second connecting rods reciprocate once along the first reciprocating path and the second reciprocating path respectively, and the first pivoting portions of the first connecting rods and the second pivoting portions of the second connecting rods rotate one circle along a closed path, and an angular change of each second connecting rod is smaller than that of each first connecting rod;

the left and right pedals are respectively mounted on the left and right second connecting rods for the user to step on with both feet respectively; each pedal has a toe end, a heel end, and a middle portion located between the toe end and heel end;

when performing the leg exercise, the middle portion of each pedal cyclically displaces relative to the frame along a predetermined pedal exercise path based on the guidance of the movement mechanism; and an elevation angle between the toe end and the heel end cyclically changes in a predetermined manner; the toe end of each pedal remains higher than the heel end.

12. The recumbent exercise apparatus as claimed in claim 11, wherein the predetermined pedal exercise path is located on vertical plane defined by a vertical and longitudinal directions of the frame, having a highest position, a lowest position, a frontmost position, a rearmost position, a maximum elevation position and a minimum elevation position, wherein the maximum elevation position is located within a path from the highest position to the lowest position while passing through the frontmost position, and the minimum elevation position is located within a path from the lowest position to the highest position while passing through the rearmost position; during the middle portion moving from the maximum elevation position to the minimum elevation position along the predetermined pedal exercise path, the elevation angle of the toe end relative to the heel end decreases gradually; and during the middle portion moving from the minimum elevation position to the maximum elevation position along the predetermined pedal exercise path, the elevation angle of the toe end relative to the heel end increases gradually.

13. The recumbent exercise apparatus as claimed in claim 12, wherein the distance of the predetermined pedal exercise path from the rearmost position to the highest position is greater than the distance from the highest position to the frontmost position.

14. The recumbent exercise apparatus as claimed in claim 12, wherein the height difference between the highest and the lowest position of the predetermined pedal exercise path in the vertical direction is smaller than the difference between the frontmost and the rearmost positions in the longitudinal direction, and the predetermined pedal exercise path has a major axis with a relatively higher front end and a relatively lower rear end.

15. The recumbent exercise apparatus as claimed in claim 12, wherein the distance between the maximum elevation position and the frontmost position of the predetermined pedal exercise path is smaller than the distance between the maximum elevation position and the highest position, and also smaller than the distance between the maximum elevation position and the lowest position; and wherein the distance between the minimum elevation position and the rearmost position of the predetermined pedal exercise path is smaller than the distance between the minimum elevation position and the highest position, and also smaller than the distance between the minimum elevation position and the lowest position.

16. The recumbent exercise apparatus as claimed in claim 12, wherein the maximum elevation position of the predetermined pedal exercise path is located between the frontmost position and the lowest position, and the minimum elevation position is located between the rearmost position and the highest position.

17. The recumbent exercise apparatus as claimed in claim 11, wherein the movement mechanism includes a left crank arm, a right crank arm, a left first swing arm, a right first swing arm, a left second swing arm and a right second swing arm, all positioned in front of the seat; each crank arm has an inner end and an outer end, the inner ends of the left and right crank arms are pivotally connected to the front portion of the frame according to a first axis, the outer ends of the left and right crank arms are 180 degrees opposite to each other with the first axis as a center and are respectively pivoted to the surrounding portion of the left and right first connecting rods; each first swing arm has an axis end and a swing end, and the axis ends of the left and right first swing arms are respectively pivoted to the front portion of the frame according to a second axis, the swing ends of the left and right first swing arms are respectively pivoted to the first reciprocating portion of the left and right first connecting rods; each second swing arm has an axis end and a swing end, the axis ends of the left and right second swing arms are respectively pivoted to the front portion of the frame according to the second axis, the swing ends of the left and right second swing arms are respectively pivoted to the second reciprocating portion of left and right second connecting rods; both the first axis and the second axis correspond to a lateral direction of the frame.

18. The recumbent exercise apparatus as claimed in claim 17, wherein the movement mechanism includes a left lever and a right lever, the left and right levers are respectively connected to the left and right first swing arms or respectively connected to the left and right second swing arms; each lever has a handle for the user to grasp; the swing end of each first swing arm and the swing end of each second swing arm are both lower than the second axis, and each handle is higher than the second axis.

19. The recumbent exercise apparatus as claimed in claim 11, wherein each first connecting rod has a front end and a rear end, the surrounding portion is located at the front end, the first pivoting portion is located at the rear end, and the first reciprocating portion is located between the front end and the rear end; each second connecting rod has a front end and a rear end, the second reciprocating portion is located at the front end, and the second pivoting portion is located behind the second reciprocating portion; and each pedal is positioned on a rear half of the corresponding second connecting rod.

20. The recumbent exercise apparatus as claimed in claim 11, wherein the first reciprocating path has a relatively higher front end and a relatively lower rear end; the closed path has a major axis with a relatively higher front end and a relatively lower rear end; the second reciprocating portion of each second connecting rod is located higher than the second pivoting portion; and wherein the second reciprocating path has a relatively higher front end and a relatively lower rear end; in a side view, the first reciprocating path intersects with an enclosed range of at least one of the circular path and the closed path, and the second reciprocating path also intersects with an enclosed range of at least one of the circular path and the closed path.

* * * * *